United States Patent [19]

Bouy et al.

[11] 4,031,041

[45] June 21, 1977

[54] CLOTH COMPRISING ASBESTOS FIBERS AND METHOD OF PRODUCING SAID CLOTH

[75] Inventors: Pierre Bouy, Enghien; Michel Juillard, Orsay; Jean-Luc Bourgeois, Paris, all of France

[73] Assignee: Rhone-Poulenc Industries, Paris, France

[22] Filed: July 31, 1975

[21] Appl. No.: 600,218

[30] Foreign Application Priority Data

July 31, 1974 France ..... 74.26563

[52] U.S. Cl. ..... 260/2.5 M; 204/252; 204/296; 260/42.27; 264/49; 264/45.3; 264/127; 264/175; 264/DIG. 17; 428/422

[51] Int. Cl.[2] ..... B29D 27/00

[58] Field of Search .... 264/127, 49, 45.3, DIG. 17, 264/175; 204/252, 296; 260/2.5 M, 42.27

[56] References Cited

UNITED STATES PATENTS

| | | | |
|---|---|---|---|
| 2,775,569 | 12/1956 | Dipner et al. | 260/42.27 X |
| 2,891,921 | 6/1959 | Kumnick et al. | 260/42.27 X |
| 3,314,916 | 4/1967 | Cupery | 260/42.27 |
| 3,477,865 | 11/1969 | Armbrust et al. | 260/42.27 X |
| 3,682,859 | 8/1972 | Taylor et al. | 260/42.27 X |
| 3,793,287 | 2/1974 | Fitz et al. | 260/42.27 X |
| 3,930,979 | 1/1976 | Vallance | 204/252 |

FOREIGN PATENTS OR APPLICATIONS

| | | | |
|---|---|---|---|
| 1,410,313 | 10/1975 | United Kingdom | 264/127 |

*Primary Examiner*—Philip Anderson

[57] ABSTRACT

A novel cloth comprising asbestos fibers, particularly in the form of a micro-porous membrane is provided and a method of obtaining this cloth. It is characterized in that said cloth is obtained by the dry mixing of asbestos fibers and at least one filler or charge substance, then working up by malaxation in the presence of a latex, forming the cloth and, optionally, elimination of the filler substance. The invention is particularly applicable in the production of a micro-porous membrane for use in electrolysis diaphragms.

21 Claims, No Drawings

CLOTH COMPRISING ASBESTOS FIBERS AND METHOD OF PRODUCING SAID CLOTH

BACKGROUND OF THE INVENTION

The present invention relates to a new product in the form of a cloth comprising asbestos fibers, and to a method of producing said cloth and particularly in the form of a microporous membrane used as a diaphragm in electrolysis cells.

It is known that the diaphragm of an electrolysis cell behaves like a porous medium and permits, on the one hand, the passage of current with a low ohmic loss and, on the other hand, the uniform flow of the electrolyte from one compartment to another. This results in a set of mechanical, electrical and hydraulic conditions which are the more critical the more it is required to operate, in modern electrolysis cells, with a high-density current, apart from tolerating prohibitive ohmic losses.

The required qualities are quite contradictory. From the mechanical point of view the diaphragm must in fact have a definite and permanent geometry and it must be uniform as regards size and texture. It is necessary to avoid the phenomenon of swelling of the diaphragm, but at the same time the diaphragm must permit the release of the gases which are sometimes generated within the diaphragm.

From the electrical point of view, the diaphragm should have good relative resistance. By the term "relative resistance" is meant the quotient of the resistance of a medium constituted by the diaphragm soaked in electrolyte in relation to the resistance of the medium constituted solely by the same electrolyte.

It has been observed that this relative resistance is related not only with the porosity of the diaphragm, but also with the shape of the ducts through which the electrolyte flows. Finally, it is desirable to avoid the phenomena of diffusion of one medium into the other through the membrane, and particularly in the case of the electrolysis of a sodium chloride solution, it is necessary to prevent the flow of $OH^-$ ions in the direction opposite to that of the stream of liquid, which flow of $OH^-$ ions is responsible for the formation of chlorate and therefore for a drop in yield of electrolytic products. The effect of this disadvantage can be reduced by increasing the thickness of the diaphragm and by reducing its porosity, but the drop in voltage in the diaphragm is then increased.

Finally, from the point of view of hydraulics, the permeability of a diaphragm should be such that the loss of pressure is low. This permeability is a function of the size of the pores, but for the above-mentioned reasons excessively large pore-diameters cannot be tolerated.

A final requirement that arises is that of continued reliability with time. Present-day technology in fact tends more and more towards the use of cells having a relatively lengthy service life. In this context, the diaphragms used are expected fully to retain all their properties with the passage of time. The difficulty in obtaining this set of quite contradictory conditions explains the large number of proposals for solving these problems that have been put forward. Thus, it was proposed many years ago to make diaphragms mainly of asbestos fibers. Such diaphragms are obtained from a dispersion of asbestos in water. These diaphragms have proved to be particularly suitable as what are known as deposited diaphragms, that is to say diaphragms formed on the cathode itself, and this technique has itself resulted from the technological requirements imposed on cells using cathodes arranged in a finger-like formation.

However, developments in the art have led, on the one hand, to the design of other types of cells, particularly the filter-pass type, and on the other hand, to an increase in current densities for reasons of efficiency and increased yield.

This has brought two consequences: first, deposited diaphragms have given way to prefabricated diaphragms since diaphragms obtained by depositing asbestos have proved to be inadequate for high current densities, i.e., in excess of 15 amperes per square decimeter. Furthermore, it is known that the deposition of asbestos fibers can only lead to structures, the porosity of which is difficult to control, said structures also suffering from the disadvantages of non-consolidated structures, namely:

1. swelling during electrolysis, this requiring a substantially large interpolar distance;
2. difficulties in obtaining thin deposits which permit a low ohmic loss; and
3. an unstable condition of the diaphragm which, after commencement of electrolysis and stabilization, render it difficult to deal with breakdowns during operations and to effect repairs of replacements in situ.

It is for these reasons that over the last few years the trend has been toward the use of diaphragms constituted by a plastics micro-porous membrane based on a polymer, usually polytetrafluoroethylene, which is resistant to the electrolytic medium.

Mixed solutions have also been proposed, for example in French Pat. No. 2,123,514, according to which there is provided a homogeneous suspension of asbestos fibers and carrier substances, such as bentonite, etc., this suspension being mixed with an acid-resistant latex.

Numerous other disclosures are to be found relating to prior art diaphragms. Mention may be made to the following patents which employ techniques of compression preforming followed by fritting, or techniques of coagulation of the mixture or depositing of this mixture on a support.

Thus, French Pat. No. 1,491,033 of Aug. 31, 1966, describes a process for manufacturing a porous diaphragm which consists in the sequence of: (1) mixing a solid additive in particulate form into an aqueous dispersion of polytetrafluoroethylene in the presence of particulate inorganic fillers, (2) then coagulating the dispersion, (3) placing the resulting coagulum in sheet form, and (4) finally removing the solid particulate additive from the sheet. The additive consists of starch or calcium carbonate and is removed at the end of the operation by immersing the resultant sheet in hydrochloric acid to dissolve the additive. The particulate inorganic fillers which are suitable are barium sulfate, titanium dioxide or powdered asbestos. They are used in proportions of between 40 and 70% of the weight of the polytetrafluoroethylene contained in the dispersion.

British Pat. No. 943,624 of Dec. 14, 1961, proposes a method of producing a filter material which consists in mixing polytetrafluoroethylene in powder form with an eliminatable powdered material, subjecting the mixture to preforming under high pressure, and then sintering the resultant shape at a temperature which does not affect the polymer, then powdered material being eliminated either by volatilization at the sintering temperature or by the addition of solvents in which it is solubilized.

German application No. 2,140,714 of Aug. 13, 1971 describes a process of manufacturing diaphragms having a base of inorganic fibers, particularly asbestos, which are bonded by a fluorinated resin. The membrane can be obtained by impregnating a paper or fabric, or else produced by the introduction of fibers into the resin suspension and shaping in accordance with a paper-making method. The sintering is then effected under elevated pressure.

All of these foregoing prior art techniques, however, have a number of drawbacks, namely:

1. Providing flat diaphragms only, either because the use of calendering or pressing makes any other shapes impossible, or that the initial suspensions, in particular when they are coagulated, do not have sufficient properties to permit homogeneous deposits on supports of complex shape.
2. Difficulties, in the case of membranes rich in polytetrafluoroethylene, in producing membranes of satisfactory mechanical properties (permitting large flow) and of good wettability.
3. Low percentage of voids is permitted in the diaphragm structure. In order to obtain good mechanical properties and excellent conservation of the cohesion during electrolysis, the quantities of pore-forming agents used are zero or low, namely, 200–300%, or less, by weight of material. Under these circumstances, the performances in the electrolysis of sodium chloride are not truly of interest — rather large ohmic drop or low Faraday yield, resulting from the reduced porosporosity of the diaphragm.

Other prior art is also less than satisfactory. British Pat. No. 1,160,084, published July 30, 1969, discloses membranes and diaphragms produced from a matrix of a fluorocarbon polymer and a combustible fibrous substrate, such as of cellulose, which can be burned out of the matrix. The resulting product is porous in nature, due to the voids left by the burning of the cellulose. According to the patent asbestos in the diaphragm is to be avoided.

British Pat. No. 1,063,244, published Mar. 30, 1967, describes a porous medium which is unsuitable for use in electrolysis cells. It is comprised of a porous base, such as of paper, having fibers, such as of asbestos, adhered to the surface, with the aid of a polymeric binder.

Bachot et al. United States patent application, Ser. No. 469,808, filed May 14, 1974, discloses a method which consists in forming an asbestos suspension in the presence of a surface-active agent and in adding to this suspension the latex of the fluoric resin and the pore-forming material. Although such a method gives good results and, in particular, enables a large quantity of pore-forming agent to be introduced, it still requires a certain proportion of asbestos and the use of a wet process.

Diaphragms having a high proportion of cavities have also been proposed, these being obtained by adding a surface-active agent to the asbestos suspension. Unfortunately, despite the improvements thus obtained, there is still considerable difficulty in controlling the formation of the coagulum, on which the qualities, particularly the electrolytic qualities, of the diaphragms depend.

In particular, this difficulty stems, on the one hand from the nature of the polymer used, which almost necessarily has to be polytetrafluoroethylene and which has to be converted by the use of heavy compression and which, during this conversion, has the troublesome tendency to retain occluded gases, and on the other hand, from the need to use carrier substances having a fine and well-defined particle-size, if it is desired to obtain a satisfactory suspension.

It is, accordingly, an object of the present invention to provide more desirable cloths to be used as diaphragms for electrolytic cells.

It is another object of the present invention to provide processes for the preparation of semi-permeable membranes having superior properties.

Other objects will be apparent to those skilled in the art from the present description.

GENERAL DESCRIPTION OF THE INVENTION

In accordance with the present invention, a new method has now been found for producing cloths comprising asbestos fibers. The cloths produced are partcularly well suited for being rendered micro-porous, and they have been found to meet the requirements imposed on diaphragms for modern high-yield, high current-density electrolysis cells.

Contrary to the teachings of the prior art, the new method is a dry method and is characterized in that:

1. in a first stage, asbestos fibers and at least one solid particulate filler or charge substance are mixed, in the dry state;
2. in a second stage, at least one latex is added while the mixture is being subjected to slow malaxation; and
3. a cloth is then formed by any known forming or shaping method.

Advantageously, the asbestos used in constituted by chrysolite, amosite, or crocidolite, preferably about 0.05 to 50 millimeters in fiber length.

The solid particulate filler or charge substance may be constituted by any mineral or other particulate material. In particular, the present invention permits the use of a wide range of particle-sizes for the charge substance. The nature and the particle-sizes of the carrier substances selected will depend upon the envisaged application and the properties required therefor. In the case where the charge substance is to be used in the manufacture of diaphragms for electrolysis, use is made of a pore-forming particulate filler, such as calcium carbonate, colloidal alumina, metallic oxides or any other product capable of being removed by a solvent or by chemical decomposition, on completion of operations. Advantageously, use can be made of a calcium carbonate as a poreformer, the particles of which have a mean diameter of between about 2 and 50 microns. Upon leading out of the pore-forming charge substance, the sheet or cloth formed is porous.

The mixing done in the first stage is preferably carried out at high stirring speeds, for example, by means of a high-speed mixer, the speed of revolution of the screw of the mixer being at least about 800 r.p.m., and mixing continuing for a period of about 5 to 30 minutes.

In the manufacture of a diaphragm for electrolysis, the latex used is preferably constituted by a latex of polytetrafluoroethylene in suspension in the order of about 50% to 60%, by weight of polymer in water. Use may also be made of other fluoric resin latexes, such as a copolymer of tetrafluoroethylene-hexafluoropropene, polychlorofluoroethylene, polychlorotrifluoroethylene, and copolymers of these, etc.

Malaxation (softening and incorporation) is carried out by means of a slow-speed malaxator, the rotor or which is advantageously driven at a speed of less than about 100 r.p.m. Malaxation may be improved by adding plasticizing agents consisting in particular of oils such as those which contain a petroleum-extract mineral base to which emulsifying agents are added.

Advantageously, the mixture obtained in the second stage comprises, for each part of asbestos, the following materials in parts by weight:

about 10 to 100 parts of solid particulate filler or charge substance
about 1 to 100 parts of polymeric resin latex
about 1 to 20 parts of water.

Shaping is preferably achieved by rolling between at least one pair or rolls turning at the same, or different, speeds. This shaping may be facilitated by operating at a temperature slightly above ambient temperature, and preferably at a temperature of between about 30° and 80° C. for a period of between about 1 and 15 min.

Advantageously, the cloth is then dried.

For the manufacture of a micro-porous membrane, said cloth is then fritted, following which the pore-forming charge substance is removed.

Fritting is preferably carried out at a temperature above the crystalline fusion temperature of the fluorinated polymeric resin and preferably at a temperature of 25° to 75° C. above the crystalline fusion temperature of the resin. In the case of a polytetrafluoroethylene latex, fritting is carried out at a temperature of between about 330° and 370° C. for a period of about 2 to 20 min.

The temperature selected will in fact depend not only upon the duration of the fritting operation, but also upon the thickness and the composition of the membrane.

When the pore-forming charge substance or agent is calcium carbonate, it can be readily removed by immersing the fritted and cooled cloth in an aqueous solution, containing 10 to 25% by weight of a weak acid, for a period of at least 24 hours. Use is preferably made of 25% acetic acid, which may contain a corrosion-inhibiting agent such as phenylthiourea in amounts of about 1 to 5%. With other pore-formers, other removal agents may be employed, such as any agent in which the pore-former is soluble, but in which the fluorinated polymer is not soluble. Thus for alumina, acid or alkali solutions may be employed. With other metal oxides other dissolving agents may also be employed.

The diaphragm obtained is then washed with water to eliminate the acid, or other dissolving agent for the poreformer, and is kept under water to avoid its hardening.

Finally the membrane is advantageously degassed by immersion in a bath of alcohol, such as methyl alcohol, and optionally placed under a partial vacuum.

Varying properties can of course be obtained by combining this technique with other techniques which are well known to the person skilled in the art and which consist for example in reinforcing the membrane by forming a layer of the membrane material on a grid or fabric, or by forming composite structures by successively depositing several layers of mixtures having different compositions.

The present invention is also concerned with a product obtained by the method of the invention.

In the non-micro-porous condition, this product is remarkable for its very high proportion of carrier substance in relation to the other components and particularly in relation to the asbestos.

Preferably, this product contains, for each part by weight of asbestos:

10 to 100 parts of at least one particulate filler or charge substance
1 to 100 parts of at least one polymeric resin latex
1 to 20 parts of water
0.5 to 2 parts of a plasticizing agent;

the ratio of the weight of the charge substance to the combined weight of latex and asbestos is preferably between 1:1 and 25:1.

In the micro-porous state, the membrane in accordance with the invention is particularly remarkable for its high proportion of cavities and for its mechanical properties.

Advantageously, and particularly in the case of a cloth comprising polytetrafluoroethylene as the polymeric resin latex and calcium carbonate as the particulate filler or charge substance, elongation is between about 1 and 200%, and rupture-strength is between about 5 and 50 kgm./cm$^2$, and when it is used for electrolysis diaphragms its micro-porosity is advantageously between about 50 and 90%, while its relative resistance is between about 1.5 and 10.

SPECIFIC DISCLOSURE OF THE INVENTION

The present invention will be more readily understood with the aid of the following examples disclosed by way of illustration and not of limitation.

EXAMPLE 1

This Example is concerned with the production of a cloth in accordance with the present invention. The procedure used was as follows:

In a first stage a mixture was produced containing 20 parts by weight of asbestos of the chrysolite type, the fibers of which had a length of between 0.5 and 5 mm., a density of between 2.3 and 2.5 grams per cubic centimeter, and a mean diameter of 180 Angstroms, and 400 parts by weight of calcium carbonate, marketed under the trademark Calibrite 14, and having a mean particle-diameter of between 15 and 20 microns.

This mixture was rapidly stirred in a Henschel type FM 10-liter mixer, the rotor of which was driven at a speed of 3800 r.p.m. for 10 minutes. The mixture so obtained was then introduced into a low-speed malaxator of the Quittard type M5 variety, the rotor of which was driven at a speed of 45 r.p.m.

100 parts by weight of a dispersion of a polytetrafluoroethylene latex, containing 60% by weight of polymer and marketed under the trademark Soreflon 60 type III, were added to this first mixture.

The mean particle-size was 0.25 microns. Also added were 21 parts of a plasticizing agent formed by a mineral-base oil to which were added emulsifying agents marketed under the name Kutwell 40. The malaxating time was 2 min.

The mixture thus obtained was then shaped in the form of a cloth by passing it through the roll-gap of a Lescuyer type IGA rolling mill, having a roll-length of 70 cm., rolling continuing for 2 min. at 50° C. The cloth thus obtained was dried for 2 hours at 90° C, and then for 1 hour at 180° C.

EXAMPLE 2

This Example is identical to Example 1, except that the final product was fritted for 6 min. at 350° C.

EXAMPLE 3

Example 2 was repeated, but the calcium carbonate was removed by immersing the cloth in a bath of 25% acetic acid for 96 hours.

EXAMPLE 4

This Example is identical to the preceding one, except that the cloth was subjected to a degassing treatment in a vacuum of 740 mm. Hg for 30 min.

The Table I below lists the properties obtained; in the Table $e$ = thickness in mm
$d$ = density
RT = tensile strength expressed in kg./cm$^2$.
A = elongation at rupture
L = values recorded in the longitudinal direction
T = values recorded in the transverse direction

TABLE 1

| | RT | | A | | | |
|---|---|---|---|---|---|---|
| EXAMPLES | L | T | L | T | e | d |
| 1 | 8 | 18 | 45 | 150 | 1.75 | 1.78 |
| 2 | 43 | 17 | 7.5 | 10 | 1.75 | 1.72 |
| 3 | 34 | 20 | 45 | 120 | 1.9 | 0.86 |
| 4 | 37 | 19 | 15 | 45 | 1.8 | 0.38 |

These Examples clearly show that in all cases cloths are obtained which have very definite and satisfactory characteristics and which suit various requirements depending upon whether it is required to obtain a more or less dense cloth or a more or less rigid cloth, or a cloth that is micro-porous or otherwise.

EXAMPLES 5, 6, 7 and 8

These Examples correspond, respectively, to Examples 1, 2, 3 and 4, except that the malaxation time was increased to 4 min., and the rolling time to 3 min.

The following Table II lists the results obtained.

TABLE II

| | RT | | A | | | |
|---|---|---|---|---|---|---|
| EXAMPLES | L | T | L | T | e | d |
| 5 | 14 | 6.5 | 60 | 40 | 1.9 | 1.76 |
| 6 | 28 | 28 | 15 | 10 | 1.9 | 1.69 |
| 7 | 29 | 22 | 30 | 70 | 9.2 | 1.19 |
| 8 | 40 | 20.5 | 30 | 50 | 2 | 0.37 |

Compared with the preceding Examples, these Examples illustrate the flexibility of the method wherein the various phases can be adjusted to modify the properties of the product obtained.

The purpose of the following Examples is to show in particular the properties of the membranes of the invention when used as diaphragms in electrolysis.

EXAMPLE 9

Membranes are produced in the manner described in the previous Examples. In particular, the same qualities of asbestos, latex and charge substance were used; the plasticizing agent used in this Example was a Kutwell 30 oil which is to the same general specification as the Kutwell 40 oil.

The operating conditions were as follows:

| | |
|---|---|
| calcium carbonate | 800 parts by weight |
| asbestos | 40 parts by weight |
| latex | 200 parts by weight of 50% dry extract |
| plasticizing agent | 39 parts by weight |

mixing - in a Henschel mixer; rotor speed: 3800 r.p.m., mixing time 10 min.
malaxation - in a Quittard malaxator: rotor speed 45 r.p.m., malaxation time 2 min.
shaping - in a Lescuyer rolling mill at 50° C. for 2 min.
Drying was carried out at 100° C. over a period of 2 hours.
Fritting was carried out at 350° C. over a period of 7 min.

The calcium carbonate charge substance was removed by immersion in 25% acetic acid for 48 hours, and degassing took place in a vacuum of 75 cm.Hg and lasted 2 hours.

The characteristics of the membranes obtained were as follows:

| | |
|---|---|
| thickness e | 1.67 mm. |
| relative resistance | 1.8 |
| permeability | 0.27 cm$^3$/min. × cm$^2$. |

Here the term "relative resistance" means the quotient of the resistance of a medium constituted by the diaphragm soaked with electrolyte in relation to the resistance of the medium constituted solely by the same electrolyte.

Permeability corresponds to the quantity of brine passing through 1 cm$^2$. of diaphragm per minute under a pressure of 54 g.

This diaphragm was used as a separator in the electrolysis of a sodium chloride solution, and gave the following results in a filter-press type cell with an iron cathode and a titanium metal anode, spaced 5 mm. apart.

current density 25 amperes per square diameter
cell voltage at equilibrium 3.47 Volts - after 150 hours composition of the liquor:
soda 125 – 130 g/l.
chlorate 0.8 – 1 g/l.
liquid pressure on the diaphragm: 4 cm of water.

EXAMPLE 10

This Example is identical to the preceding one except that the rolling operation was varied to give a greater thickness of diaphragm, i.e., 1.84 mm., and a lower permeability, i.e., 0.08 ml/min. × cm$^2$.

The results of the electrolysis test were as follows:

The results of the electrolysis test were as follows:
current density 25 amperes per square decimeter
equilibrium voltage 3.4 volts
liquor:
soda 120 g/l.
chlorate 0.4 – 0.5 g/l.
liquid pressure on the diaphragm: 15 cm. of water.

EXAMPLE 11

This Example is identical to Example 9 except that the mixture contained 10 parts of asbestos instead of 40.

The membrane had the following characteristics:

thickness — 1.43 mm
relative resistance — 1.7
permeability — 0.24 $cm^3/min. \times cm^2$
The electrolysis test results were as follows:

| | |
|---|---|
| soda | 125 g/l. |
| chlorate | 0.8 – 0.9 g/l. |
| liquid pressure on the diaphragm: 2 cm. of water. | |

EXAMPLES 12 and 13

These Examples are identical to the preceding ones except as regards the composition of the mixture which was as follows:

| | |
|---|---|
| calcium carbonate | 500 parts by weight |
| asbestos | 20 parts by weight |
| latex | 200 parts by weight of a 50% dry extract |
| plasticizing agent | 25 parts by weight. |

The thicknesses of the diaphragm were respectively 1.43 mm and 2.63 mm.

The properties of the membranes were as follows:

| EXAMPLES | 12 | 13 |
|---|---|---|
| Relative resistance | 2.8 | 3 |
| Permeability $cm^3/min. \times cm^2$. | 0.15 | 0.08 |

The results of the electrolysis tests were as follows:

| EXAMPLES | 12 | 13 |
|---|---|---|
| Current density in $A/dm^2$. | 25 | 25 |
| Equilibrium voltage | 3.04 | 3.63 |
| Liquor: | | |
| soda (g/l.) | 120 | 140–150 |
| chlorate (g/l.) | 0.4 | 0.3 |
| Liquid pressure on the diaphragm in cm. of water | 6 | 35 |

EXAMPLE 14

This Example is identical to the previous ones except as regards to the fritting operation, which was carried out at 350° C. during a period of 11 min., and as regards the thickness of the diaphragm, which was 1.51 mm.

The properties of the membranes were as follows:

| | |
|---|---|
| The properties of the membrane were as follows: | |
| relative resistance | — 4.1 |
| permeability | — 0.18 $cm^3/min. \times cm^2$. |
| The results of the electrolysis test were as follows: | |
| current density | 25 $A/dm^2$ (Amperes per square decimeter) |
| equilibrium voltage | 3.12 volts |
| liquor: | |
| soda | 124 g/l. |
| chlorate | 0.7 g/l. |
| liquid pressure on the diaphragm 7 cm. of water. | |

EXAMPLE 15

The composition of the materials used in this Example were as previously stated, but the operating conditions were as follows:

| | |
|---|---|
| mixing | 3800 r.p.m. for 10 min. |
| malaxation | 45 r.p.m. for 2 min. 15 sec. |
| rolling | 2 min. at 50° C. |
| drying | 2 hours at 90° C; 2 hours at 180° C. |
| fritting | 3 min. at 365° C. |
| removal of carrier substance: | immersion in 25% acetic acid for 90 hours |
| degassing | 1 hour 30 min. under a vacuum of 740 mm Hg |
| thickness | 1.94 mm |
| The properties of the membrane were as follows: | |
| relative resistance | 2.8 |
| permeability | 0.14 $cm^3/min. \times cm^2$ |
| The results of the electrolysis test were as follows: | |
| current density | 25 $A/dm^2$ |
| equilibrium voltage | 3.25 volts |
| liquor: | |
| soda | 118 g/l. |
| chlorate | 0.9 g/l. |
| liquid pressure on the diaphragm 2.8 cm. of water. | |

EXAMPLE 16

The conditions were the same as in the preceding Example, except that Calibrite 14 was replaced by a calcium carbonate marketed under the trademark OMYA BLE, and that the thickness was 1.55 mm.

The properties of the membrane were as follows:

| | | |
|---|---|---|
| relative resistance | — | 2.2 |
| permeability | — | 0.10 $cm.^3/min. \times cm.^2$ |

The results of the electrolysis test were as follows:

| | |
|---|---|
| current density | 30 $A/dm^2$ |
| equilibrium voltage | 3.45 volts |
| liquor: | |
| soda | 122 g./l. |
| chlorate | 1 g./l. |
| liquid pressure on the diaphragm: 18 cm. of water. | |

EXAMPLE 17

In this Example use was made of a composition comprising two carrier substances of different particle-size.

The composition used was as follows:

| | |
|---|---|
| Calibrite 14 | 320 parts by weight |
| OMYA BLE | 80 parts by weight |
| asbestos | 20 parts by weight |
| plasticizing agent | 40 parts by weight |

The other conditions were identical to those of Example 17.

The properties of the diaphragm obtained were as follows:

| | |
|---|---|
| relative resistance | 5.1 |
| permeability | 0.19 $cm^3/min. \times cm^2$. |

The results of the electroylsis test were as follows:

| | |
|---|---|
| current density | 30 $A/dm.^2$ |
| equilibrium voltage | 3.42 volts |
| liquor: | |
| soda | 125 g/l |
| chlorate | 1 g/l |
| liquid pressure on the diaphragm 11 cm of water. | |

EXAMPLE 18

In this Example a test was carried out using a membrane forming a layer on a galvanized steel grid having a wire diameter of 0.25 mm., a nominal aperture size of 1.40, a useful surface of 72%, and a weight of 460 g/m.$^2$.

The composition of the mixture was as follows:

| | |
|---|---|
| carrier substance (Calibrite 14) | 500 parts by weight |
| asbestos | 20 parts by weight |
| polytetrafluoroethylene | 100 parts by weight |
| plasticizing agent | 25 parts by weight |

The operating conditions were identical to those of Example 9, except that fritting was carried out for 15 min. at a temperature of 385° C.

The properties of the membrane were as follows:

| | |
|---|---|
| relative resistance | 2.5 |
| permeability | 0.15 cm.$^3$/min. × cm.$^2$ |

The mechanical properties of the unreinforced membrane were as follows:

| | |
|---|---|
| tensile strength: | |
| Longitudinal | 16 kg./cm.$^2$ |
| transverse | 8 kg./cm.$^2$ |
| elongation: | |
| longitudinal | 40% |
| transverse | 25% |

The results of the electrolysis test were as follows:

| | |
|---|---|
| current density | 30 A/dm$^2$ |
| equilibrium voltage | 3.36 volts |
| liquor: | |
| soda | 120 g./l |
| chlorate | 0.9 g./l |
| liquid pressure on the diaphragm: 20 cm. of water. | |

EXAMPLE 19

In contrast with the previous Examples, in this Example the two rolls of the rolling mill were driven at different speeds, one turning 1.2 times faster than the other.

The other conditions were as follows:

| | |
|---|---|
| The other conditions were as follows: | |
| composition of the mixture: | |
| carrier substance (Calibrite 14) | 400 parts by weight |
| polytetrofluoroethylene | 20 parts by weight |
| asbestos | 100 parts by weight |
| polytetrofloroethylene | 26 parts by weight |
| plasticizing agent | |
| mixing | 10 min. at 3800 r.p.m. |
| malaxation | 4 min. at 45 r.p.m. |
| drying | 90° C. for 2 hours |
| rolling | 50° C. for 4 min. |
| fritting | 350° C. for 6 min. |
| removal of carrier substances | immersion in 25% acetic acid for 84 hours |
| degassing | 30 min. under a vacuum of 750 mm. Hg. |

The properties of the membrane were as follows:

| | |
|---|---|
| relative resistance | 3.5 |
| permeability | 0.17 cm$^3$/min. × cm$^2$. |

-continued

| | |
|---|---|
| The results of the electrolysis test were as follows: | |
| current density | 30 A/dm$^2$ |
| equilibrium voltage | 3.5 volts |
| liquor: | |
| soda | 130 – 140 g./l. |
| chlorate | 1 g./l. |
| liquid pressure on the diaphragm: 11 cm. of water. | |

These Examples, by which the invention is in no way limited, illustrate the considerable advantages of the method which enables a product to be produced that is remarkable both for its mechanical properties and its electrochemical characteristics.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A method of obtaining a sheet comprising asbestos fibers and a fluorocarbon polymeric resin, which process comprises, in a first stage asbestos fibers and at least one solid particulate mineral filler substance are mixed at substantially high speed of at least about 800 R.P.M. in the dry state, in a second stage at least one fluorocarbon polymeric resin latex is added and mixed with the resulting dry mixture, and finally a sheet is then formed from the resulting mixture.

2. A method according to claim 1, wherein a plasticizing agent is added in said second stage to the resulting dry mixture to slow malaxation, in a third stage, shaping the resulting mass into a sheet by rolling between at least one pair of rolls.

3. A method according to claim 2, wherein the resulting sheet is sintered.

4. A method according to claim 1, wherein said first stage mixing is carried out by means of a mixer having a high-speed screw, and said first stage mixing continuing during a period of between about 5 and 30 minutes, in a second stage a fluorocarbon polymeric resin latex and a plasticizing agent are added to the dry mixture thus produced by subjecting the entire mixture to malaxation by means of a low speed malaxator, the speed of revolution of the rotor of which is at most 100 r.p.m., malaxation continuing for a period of between 1 and 15 min., in a third stage shaping the mass into a sheet by rolling between at least two pair of rolls, the sheet then being dried, and in a fourth stage the sheet thus obtained is sintered at a temperature above the fusion-point of said fluorocabon salymeric resin.

5. A method of obtaining a sheet comprising asbestos fibers according to claim 2, wherein rolling is carried out at a temperature of between 30° and 80° C.

6. A method according to claim 2, wherein rolling is carried out by passing the mixture between at least one pair of rolls driven at the same speed.

7. A method according to claim 2, wherein rolling is carried out by passing the mixture between at least one pair of rolls driven at different speeds.

8. A method according to claim 1, wherein the mixture contains, for each part of asbestos, 10 to 100 parts by weight of at least one particulate filler substance, 1 to 100 parts by weight of polymeric resin latex, 0.5 to 2 parts by weight of a plasticizing agent and 1 to 20 parts of water.

9. A method according to claim 1, wherein at least one particulate mineral filler substance is calcium carbonate and that the latex is of polytetrafluoroethylene.

10. A method of obtaining a micro-porous membrane according to claim 1, wherein at least one of the mineral filler substances introduced during the first stage is a pore-forming agent, and in that the pore-forming agent is removed at a later stage.

11. A method of obtaining a micro-porous membrane according to claim 10, wherein the pore-forming agent is constituted by calcium carbonate, and in that this pore-forming agent is eliminated by immersion in an aqueous acid solution.

12. A method according to claim 11, wherein the aqueous acid solution is a 10 to 25% solution of acetic acid.

13. A method according to claim 10, wherein the resulting membrane is degassed at reduced pressure.

14. A method according to claim 1, wherein the asbestos used is composed of fibers of 0.5 to 50 millimeters in length.

15. A method according to claim 10, wherein the pore-former used is a member selected from the class consisting of calcium carbonate, colloidal alumina and metallic oxides.

16. A novel sheet comprising asbestos fibers, wherein it is obtained by the method of claim 1.

17. A novel sheet according to claim 16, wherein it comprises, for each part of asbestos, 10 to 100 parts of at least one particulate filler substance, 1 to 100 parts at least one fluorocarbox polymeric resin latex, 0.5 to 2 parts of a plasticizing agent and 1 to 20 parts of water, the ratio of the weight of the particulate filler substance to the combined weights of the latex and the asbestos being between 1:1 and 25:1.

18. A novel sheet according to claim 16, wherein it has an elongation of between about 1 and 200%, and a rupture strength of between about 5 and 50 kg/cm$^2$.

19. A novel microporous sheet wherein it is obtained by the method of claim 10.

20. A novel micro-porous sheet according to claim 16, wherein it has a relative resistance of between about 1.5 and 10, and a micro-porosity of between about 50 and 90%.

21. A novel diaphragm for electrolysis cells, wherein it is constituted by a sheet according to claim 19.

* * * * *

UNITED STATES PATENT OFFICE

CERTIFICATE OF CORRECTION

Patent No. 4,031,041 Dated June 21, 1977

Inventor(s) Pierre Bouy et al.

It is certified that error appears in the above-identified patent and that said Letters Patent are hereby corrected as shown below:

Col. 2, line 7, delete "pass" and replace with -- press --.

Col. 4, line 37, delete "in" and replace with -- is --.

Col. 7, line 62, delete "are" and replace with -- were --.

Col. 8, line 57, delete "The results of the electrolysis test were as follows:"

Col. 9, line 7, insert after "The electrolysis test results were as follows:" the following:

-- current density 25 $A/dm^2$ (Amperes per square decimeter)

equilibrium voltage 3.13 volts liquor: --

Col. 9, line 51, delete "membranes" and replace with -- membrane --.

Col. 9, line 54, delete "The properties of the membrane were as follows:"

UNITED STATES PATENT OFFICE

CERTIFICATE OF CORRECTION

Patent No. 4,031,041 Dated June 21, 1977

Inventor(s) Pierre Bouy et al.

It is certified that error appears in the above-identified patent and that said Letters Patent are hereby corrected as shown below:

Col. 12, line 53, delete "salymeric" and replace with -- polymeric --.

Col. 14, line 8, delete "fluorocarbox" and replace with -- fluorocarbon --.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*